United States Patent [19]

Yu

[11] Patent Number: 4,745,261

[45] Date of Patent: May 17, 1988

[54] WARMING FAN

[75] Inventor: Chih-Hua Yu, Taipei, Taiwan

[73] Assignee: Taiwan Electric Heating Equipment Co., Ltd., Taipei, Taiwan

[21] Appl. No.: 76,844

[22] Filed: Jul. 23, 1987

[51] Int. Cl.[4] ..... F24H 3/00; H05B 1/00

[52] U.S. Cl. ..... 219/364; 318/814

[58] Field of Search ..... 219/364, 371, 374; 318/814, 796, 797

[56] References Cited

U.S. PATENT DOCUMENTS

| | | | |
|---|---|---|---|
| 2,509,137 | 5/1950 | Denman | 219/371 |
| 3,576,483 | 4/1971 | Gambill | 318/814 |
| 3,576,484 | 4/1971 | Gambill | 318/814 |

*Primary Examiner*—C. L. Albritton

*Attorney, Agent, or Firm*—Saidman, Sterne, Kessler & Goldstein

[57] ABSTRACT

A warming fan with a speed reducing device comprises a choke coil which connects with the running inductor of the power set of the warming fan, a diode which is paralleled to the choke coil and a choke coil which is paralleled to the above-mentioned choke coil and connected in series with the diode in the downstream of the same. The warming fan can keep its revolution speed low enough and keep its revolution torque high enough, because the power set of the warming fan is driven by a relatively high voltage corresponding to its revolution speed, but which is interrupted intermittently.

4 Claims, 3 Drawing Sheets

WARMING FAN

BACKGROUND OF THE INVENTION

The present invention relates to a warming fan, and more particularly to that type of warming fan with a speed reducing device by which the revolution speed of the fan can be kept low enough and torque of the same can be kept high enough.

As is well known, the type of fan with a heating device is in fashion in todays domestic appliance market because it may be used for a warm breeze on cold days and a cool wind on hot days just by switching the heating device or or off. The conventional type of warming fan generally comprises a fan set, a power set for driving the fan set, a heating device installed on one side of the fan set and an electrical control device for controlling the power supply of the power set and the heating device. The power set of a conventional fan is always a single phase inductive motor which comprises a starting inductor and a running inductor. As is well known, when we want to get a warm breeze, we should cut down the speed of the air flow from the fan set in addition to switching on the heating device, and when we want to cut down the speed of the air flow, we should cut down the revolution speed of the fan set. The conventional fan usually has several stages for controlling the revolution speed, such as a high speed button, a mid speed button and a low speed button, but the low limit of such a conventional fan is 800 RPM, which is still too fast to allow the breeze to warm up enough. Some people try to cut down the voltage to the running inductor by a speed reducing device comprising TRIAC or SCR which is connected between the downstream of the running inductor and the power source. But this method is not practical, because, as the voltage is reduced, the torque for running the fan is also reduced positively. And, when the voltage is low enough, such as 40 volts for 300 RPM, the torque almost can not run the fan, and the fan will be burned by the heat generated by the heating device as soon as it stops.

SUMMARY OF THE INVENTION

Therefore, an object of the present invention is to provide a warming fan which can keep the revolution speed low enough and keep the torque high enough.

A further object of the present invention is to provide a warming fan which can supply power with a high enough voltage but with the negative half cycle hindered and lagging a period, that is to say, the power supply of which can be interrupted intermittently, so that the revolution speed of the fan driven by a relatively high torque can be reduced.

Accordingly, the present invention provides a warming fan which comprises a fan set, a power set, having a starting inductor and a running inductor, for driving the fan set, a heating device installed on one side of the fan set, an electrical control device for connecting and controlling the power set, the heating device and the power source and a speed reducing device connected between the downstream of the running inductor and the power source, wherein the speed reducing device comprises a choke coil, a diode paralleled to the choke coil and a choke coil connected in series with the diode in the downstream of the same and paralleled to the above-mentioned choke coil, so the voltage to the running inductor can be reduced to a certain level which can maintain the fan set torque at running level, and the negative half cycle of which can be reduced and lag a period of time for reducing the revolution speed of the fan set by the function of the diode and the choke coils.

BRIEF DESCRIPTION OF THE DRAWINGS

The present invention is illustrated by way of example in the accompanying drawings, in which.

DETAILED DESCRIPTION OF THE INVENTION

Figure 1:
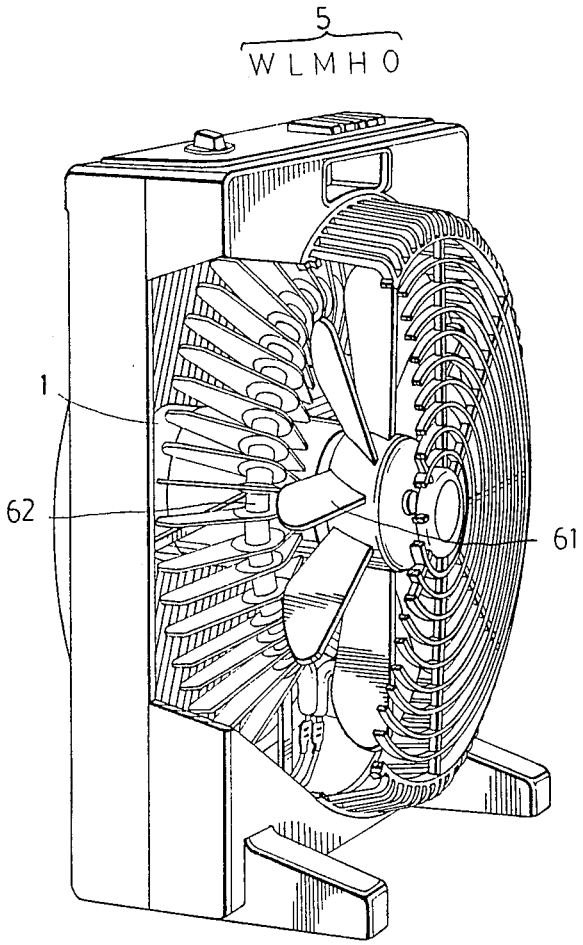
FIG. 1 is a perspective view of the warming fan according to the present invention.
Figure 2:
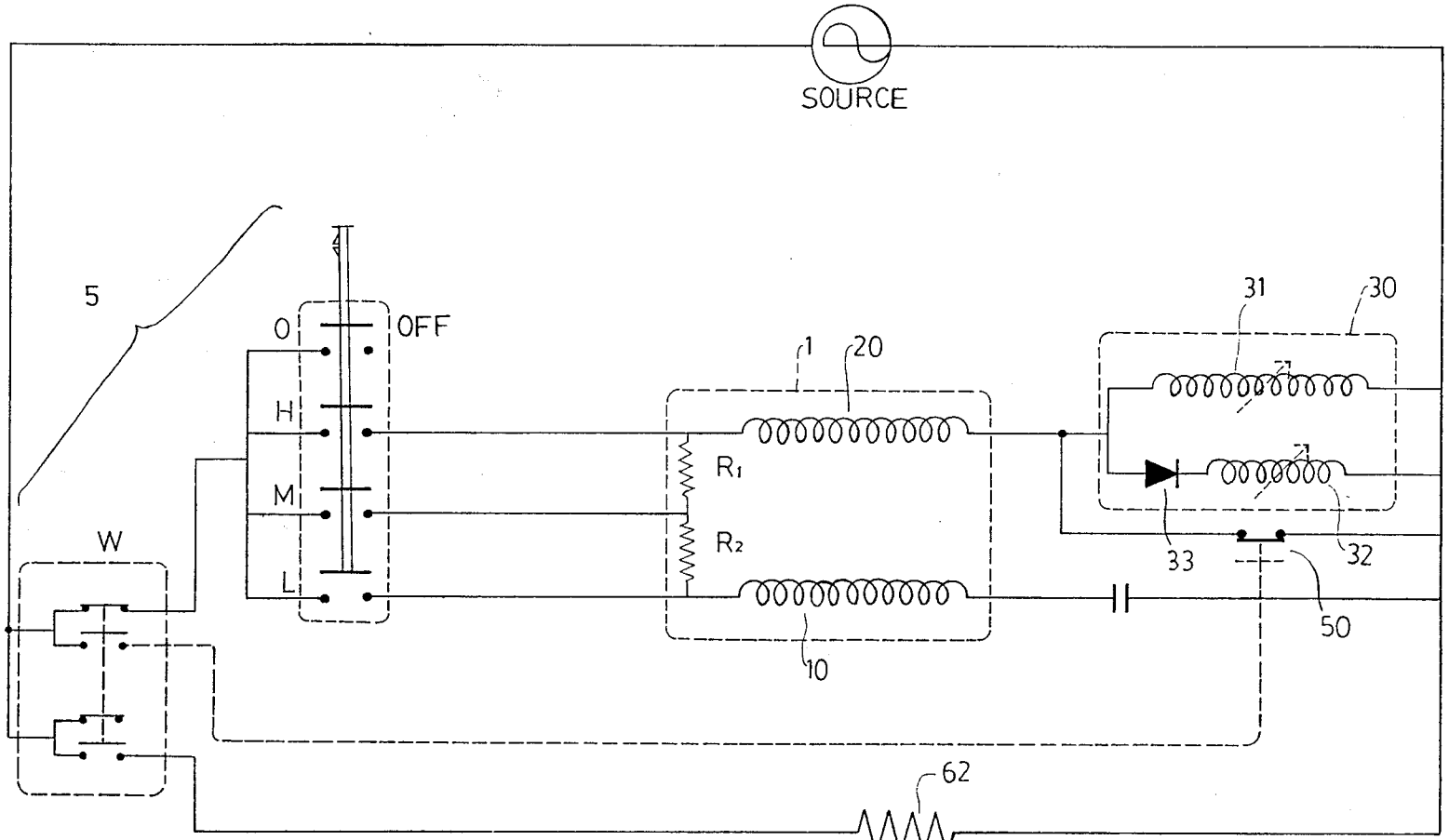
FIG. 2 is a circuit diagram of the warming fan according to the present invention.

Referring to FIG. 1 which is a perspective view of an embodiment according to the present invention, the warming fan comprises a fan set 61, a power set 1 for driving the fan set 61, a heating device 62 installed in the inside of the fan set 61 and an electrical control device 5 having a switching-off button O, a high speed button H, a mid speed button M, a low speed button L and a warming button W. As shown in FIG. 2, the electrical control device 5 connects the upstream of power set 1 to the power source. The power set 1 (single phase inductive motor: 110 V, 60 HZ, 0.44 A, 50 W) comprises a starting inductor 10 and a running inductor 20, the downstream of which connects to power source. A magnetic switch 50 of normal-on type, which is interlocked by the warming button W, is connected between the downstream of the running inductor 20 and the power source. Parallel to the magnetic switch 50, a speed reducing device 30 is connected between the downstream of the running inductor 20 and the power source. The speed reducing device 30 comprises an adjustable choke coil 31 ($0.23^{\phi} \times 1300^{7}$), a diode 33 (IN 4007) paralleled to the choke coil 31 and an adjustable choke coil 32 ($0.23^{\phi} \times 47.5^{7}$) connected in series with the diode 33 in the downstream of the same and paralleled to the above-mentioned choke coil 31.

Figure 3:
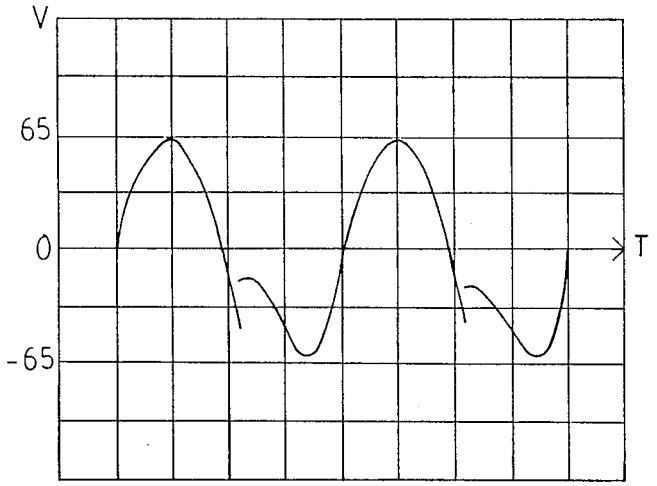
FIG. 3 is the wave form chart of the voltage upon the power set of the warming fan according to the present invention.
Figure 4:
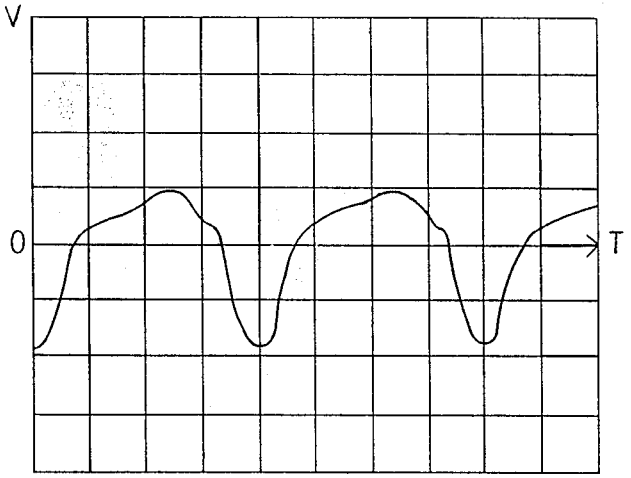
FIG. 4 is the wave form chart of the voltage upon the speed reducing device of the warming fan according to the present invention.

When the button H, M or L is pushed, the current which flows through the running inductor 20, shall be led through the magnetic switch 50 and come back to the power source, but, when the button W is pushed, the heating device 62 shall operate, and in addition to that, the magnetic switch 50 shall be opened, causing the current which flows through the running inductor 20, to be led through the speed reducing device 30 and back to the power source. As shown in FIG. 3, as the current, which flows through the running inductor 20, is led through the speed reducing device 30, the voltage of the positive half cycle to the running inductor 20 shall be kept in the shape of sine wave with 65 volts, and the voltage of the negative half cycle shall be reduced and lag a period Qof time between $\pi$ and $3/2\pi$.

As in the above-mentioned embodiment, the warming fan, according to the invention, can be driven by a relatively high voltage and the revolution speed of which can be kept in a relatively low speed, e.g. 300 RPM, which can not kept by the conventional warming fan.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the broadest interpretation so as to encompass all such modifications and equivalent arrangements.

What is claimed is:

1. A warming fan comprising:

a fan set;

a power set for driving the fan set, having a starting inductor and a running inductor;

a heating device installed on one side of the fan set; an electrical control device for connecting and controlling the power set and the heating device and the power source; and a speed reducing device connected in series with the running inductor of the power set between the running inductor and the power source;

wherein the speed reducing device comprises a choke coil, a diode paralleled to the choke coil and a choke coil connected in serise with the diode in the downstream of the diode and paralleled to the above-mentioned chode coil.

2. A warming fan as claimed in claim 1, wherein the electrical control device comprises a plurality of button switches which connect the power set and the speed reducing device to the power source in series, and one of which connects the heating device to the power source.

3. A warming fan as claimed in claim 2 further comprising a magnetic switch of normal-on type which is paralleled to the speed reducing device and interlocked by the button switch connecting the heating device to the power source.

4. A warming fan as claimed in claim 3 wherein the choke coils used are adjustable choke coils.

* * * * *